United States Patent [19]

Bowlay-Williams

[11] Patent Number: 4,898,115

[45] Date of Patent: Feb. 6, 1990

[54] LINE IDENTIFYING BOOKMARK

[76] Inventor: Iris E. Bowlay-Williams, 6833 Sepulveda Blvd., #310, Van Nuys, Calif. 91405

[21] Appl. No.: 323,339

[22] Filed: Mar. 14, 1989

[51] Int. Cl.[4] ..... B42D 9/00

[52] U.S. Cl. ..... 116/236; 24/18; 24/563; D19/34

[58] Field of Search ..... 116/234–240; 281/18, 42; 24/18, 67.9, 563; 40/658, 666; D19/34

[56] References Cited

U.S. PATENT DOCUMENTS

| | | | |
|---|---|---|---|
| 308,942 | 12/1884 | Yewell | 281/42 |
| 370,525 | 9/1887 | Bieber | 281/42 |
| 877,428 | 1/1908 | Hugo | 24/18 |
| 899,035 | 9/1908 | Dunn | 281/18 |
| 1,193,421 | 8/1916 | Prettyman | 116/236 |
| 1,263,518 | 4/1918 | Brorby | 24/18 |
| 1,338,861 | 5/1920 | Frame | 116/240 |
| 1,627,110 | 5/1927 | Norris | 116/237 X |
| 2,001,650 | 5/1935 | Bane | 116/235 |

FOREIGN PATENT DOCUMENTS

| | | | |
|---|---|---|---|
| 612875 | 11/1948 | United Kingdom | 116/235 |

*Primary Examiner*—William A. Cuchlinski, Jr.
*Assistant Examiner*—W. Morris Worth
*Attorney, Agent, or Firm*—Stetina and Brunda

[57] ABSTRACT

A bookmark device is disclosed which is adapted to mark a particular line on a particular page of a book. The device includes a generally rectangular member having a plurality of portions and segments which fit about the page to be identified and which are further adapted to underline and thereby identify a particular line on a book page. Portions of a tying member are connected to one end of the rectangular member and may be wrapped around the outside of the book and tied near the book spine to releasably retain the book in its closed configuration.

5 Claims, 1 Drawing Sheet

LINE IDENTIFYING BOOKMARK

FIELD OF THE INVENTION

The present invention relates to bookmark devices utilized to identify a page of a book for future reference, and more particularly to an improved bookmark which can be used to mark a particular line on a particular page of a book.

BACKGROUND OF THE INVENTION

As is well known, a wide variety of bookmark devices are available which can be utilized to generally locate the place in a book where a reader has stopped reading and desires to resume reading at a later time. These devices are typically formed from an elongate rectangular strip of construction paper or other material available in thin sheets in which the particular design is determined primarily by aesthetic appearance considerations. It has been found, however, that such bookmark devices as are heretofore known in the art have limited utility in that they are not well adapted for identifying the particular line on a particular page of a book at which the reader desires to resume reading at a later time. Although it is commonly known to place such a device on a page with an edge of the device positioned thereon to underline a particular line, since line identification is frequently lost, since the bookmark has a tendency to slide or fall downwardly when the book is turned to a vertical orientation for shelving or reopening. Even when the reader undergoes the inconvenience of carefully shelving and reopening the book in a horizontal orientation, these prior art devices fail, upon reopening the book, to provide a means for identifying which of two facing pages the reader had intended to identify with the bookmark. Other contemporary bookmarks are suited to remain in place when the book is opened, yet they do not indicate which side of the marked page is being referenced as the page and line of interest to the reader.

As such, there exists a need in the art for a bookmark device which can be used to identify a particular line on a particular page of a book for future reading and which is further adapted to retain this line identification without requiring the reader to undergo the inconveniences noted above.

SUMMARY OF THE INVENTION

The present invention specifically addresses and satisfies the above-reference need in the art by providing a bookmark device comprising a generally rectangular member which is further formed to include a plurality of elongate portions adapted to be fitted about the page to be identified so that an edge of one of the portions can be used to mark a particular line on a page where future reading is to begin. The present invention also includes a tying member affixed to the rectangular member which can be tied around the outside of the book to hold it securely in its closed configuration.

BRIEF DESCRIPTION OF THE DRAWINGS

These and other features of the present invention will become more apparent upon reference to the drawings wherein.

DETAILED DESCRIPTION OF THE PREFERRED EMBODIMENT

The detailed description set forth below is intended merely as a description of the presently preferred embodiment of the invention, and is not intended to represent the only form in which the present invention may be constructed or utilized. The description below sets forth the structure of the invention in accordance with the illustrated embodiment. It is to be understood, however, that the same or equivalent structures are intended to be encompassed within the spirit and scope of the invention.

Figure 1:
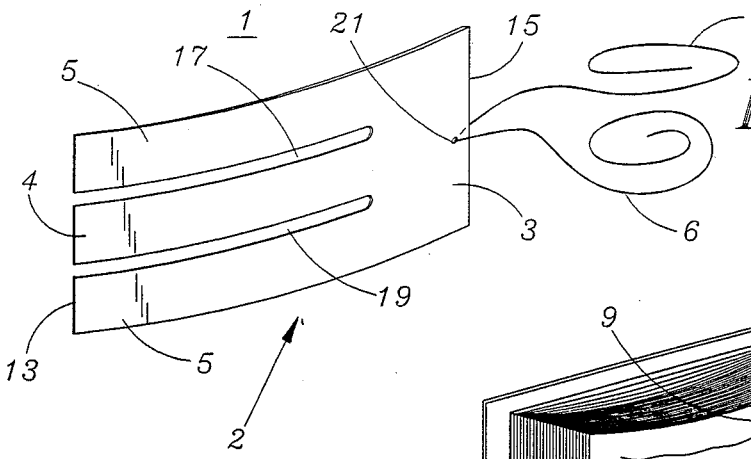
FIG. 1 is a perspective view of the preferred embodiment bookmark device of the present invention.

Referring to FIG. 1 there is shown the presently preferred embodiment of the line identifying bookmark device of the present invention. The bookmark 1 includes a generally rectangular member 2, which may be formed from a single piece of construction paper such as that typically utilized in bookmark applications or any other material which can be formed into a flattened sheet adaptable to the construction and functions of the present invention as described below. In the preferred embodiment, the bookmark 1 is formed from rectangular member 2 simply by forming two generally parallel separations or cuts 17, 19 which extend from the peripheral side or edge 13 and terminate at a distance short of the opposite peripheral edge 15, wherein the portion of rectangular member 2 between the cut terminations and the opposite peripheral edge comprises a first portion 3 and the remaining three elongate appendanges or strips separated by the cuts comprise a second portion which is formed to receive and engage a page of a book. The second portion includes a first segment 4 disposed between two second segments 5. The present invention also includes a tying member for holding the book in a closed configuration after use once the bookmark 1 is in place, which in the preferred embodiment consists of a string extending through aperture 21 formed in the first portion 3 of rectangular member 2. Tying member 6 may also be formed from ribbon such as that typically utilized in gift wrapping applications.

Figure 2:
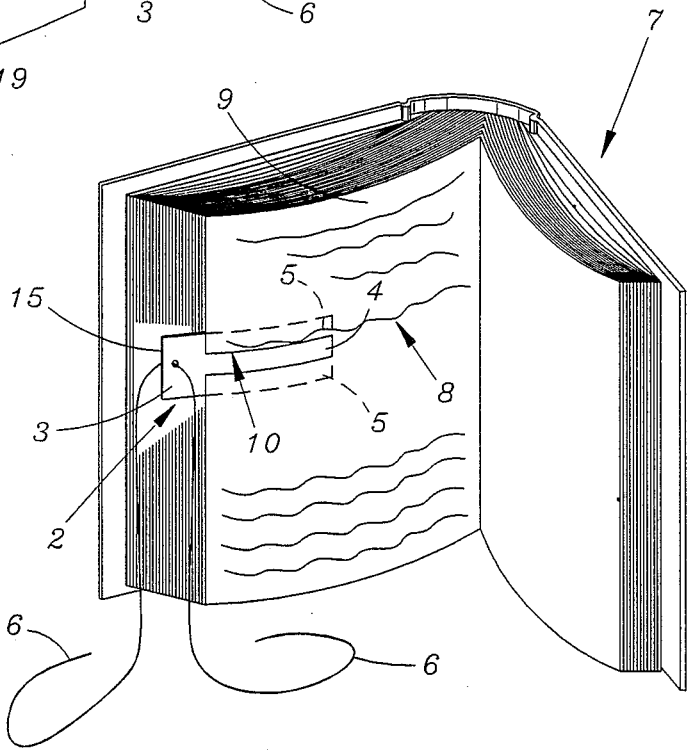
FIG. 2 is a perspective view illustrating how the preferred embodiment of the bookmark is utilized to mark a particular line on a particular page of a book.

FIG. 2 illustrates the use of the preferred embodiment of the present invention. After reading a portion of a book 7 the reader can mark for future identification a particular line 8 on a particular page 9 at which to resume reading at a later time. Segments 4 and 5 are disposed about page 9 so that first segment 4 is disposed upon page 9 with its upper edge 10 being positioned parallel to and below the line 8 to identify the same as the line to resume future reading. Segments 5 are disposed on the opposite side of page 9, and cooperate with segment 4 to hold the bookmark in place identifying the particular line of interest.

Figure 3:
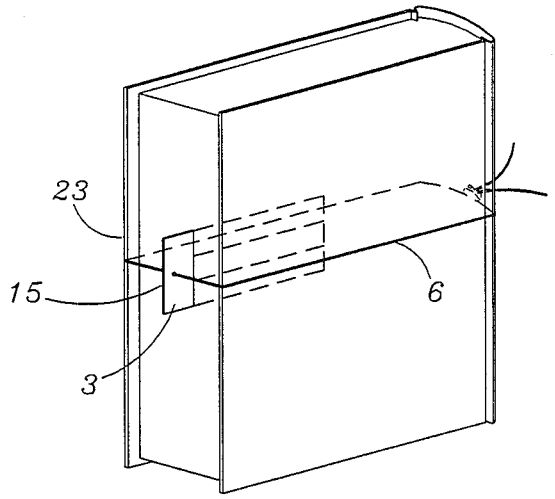
FIG. 3 illustrates the preferred embodiment tying means of the present invention utilized to hold a book in a closed configuration.

When the bookmark 1 is in position on page 9, first portion 3 extends from the edge of the page. The length of cuts 17, 19 may be selected such that edge 15 extends along substantially the same vertical plane as the edges, e.g. edge 23, of book 7. The closed book 7 can be optionally retained or held in its closed configuration by wrapping the two ends of tying member or cord 6 around the outside of the book and tying ends together at a point near the book spine 10 as shown in FIG. 3.

It is to be understood that various alterations, modifications, additions and improvements to the presently preferred embodiment may be implemented without departing from the broader aspects of the invention. For example, a different number of segments may be utilized to engage a book page and identify a particular line. The sizes and shapes of the segments could also be modified. These and other modifications will be apparent to those of ordinary skill in the art in view of the particular application desired.

What is claimed is:

1. A bookmark identifying a particular line and page of a book comprising:

a generally rectangular member having a first portion extending from the page to be identified and a second portion fitting about the page to be identified;

said second portion having a first segment disposable on the page to be identified and formed to identify a particular line, and a second segment disposable on the rear of the page to be identified;

said first and second segments being cooperative to hold the bookmark in place on a particular line and page of the book; and at least one tying member attached to said rectangular member, said tying member having sufficient length to extend around the outside of the book and hold the book in a closed configuration while the bookmark is held in place on the particular line and page of the book.

2. The bookmark as recited in claim 1 wherein said second portion comprises a plurality of elongate strips connected to said first portion at one end thereof, said elongate strips being formed to receive and engage the page to be identified.

3. The bookmark as recited in claim 2 wherein said second portion comprises three elongate strips.

4. The bookmark as recited in claims 3 wherein said first segment comprises one of the elongate strips and wherein said second segment comprises the remaining two elongate strips.

5. The bookmark as recited in claim 1 wherein the tying member comprises a length of cord having first and second ends, said cord having sufficient length that said first and second ends may be tied together about the book to maintain the book in the closed configuration.

* * * * *